US008671633B2

(12) United States Patent
Haab et al.

(10) Patent No.: US 8,671,633 B2
(45) Date of Patent: Mar. 18, 2014

(54) FOLDABLE SLIDING WALL AND CARRIAGE

(71) Applicant: Hawa AG, Mettmenstetten (CH)

(72) Inventors: Gregor Haab, Allenwinden (CH); Peter Ettmuller, Jonen (CH); Hans Wuthrich, Wettswil (CH); Nejib Yezza, Rickenbach B. Schwyz (CH)

(73) Assignee: Hawa AG, Mettmenstetten (CH)

( * ) Notice: Subject to any disclaimer, the term of this patent is extended or adjusted under 35 U.S.C. 154(b) by 0 days.

(21) Appl. No.: 13/709,580

(22) Filed: Dec. 10, 2012

(65) Prior Publication Data

US 2013/0145705 A1 Jun. 13, 2013

(30) Foreign Application Priority Data

Dec. 12, 2011 (EP) ..... 11193109

(51) Int. Cl.
*E04H 1/00* (2006.01)

(52) U.S. Cl.
USPC ..... 52/243.1; 52/29; 52/238.1; 160/206

(58) Field of Classification Search
USPC ..... 52/29.235, 238.1, 243.1; 49/125, 49/127–13, 358, 360, 362, 409–411, 425; 160/201, 206, 214; 16/87 R, 90, 91, 16/95 W, 96 R, 97, 98, 100, 106–107, 87 B
See application file for complete search history.

(56) References Cited

U.S. PATENT DOCUMENTS

| | | | | | |
|---|---|---|---|---|---|
| 3,295,257 | A * | 1/1967 | Douglass | 49/317 |
| 3,479,682 | A * | 11/1969 | McNinch | 16/97 |
| 3,708,827 | A * | 1/1973 | Foltz | 16/98 |
| 4,073,092 | A * | 2/1978 | Williams | 49/127 |
| 5,042,555 | A * | 8/1991 | Owens | 160/199 |
| 5,301,735 | A * | 4/1994 | Chen | 160/199 |
| 5,499,671 | A * | 3/1996 | Owens | 160/199 |
| 5,581,944 | A * | 12/1996 | Kornbrekke et al. | 49/28 |
| 5,603,192 | A * | 2/1997 | Dickson | 52/238.1 |
| 6,286,258 | B1 | 9/2001 | Bischof et al. | |
| 6,301,833 | B1 * | 10/2001 | Airikkala | 49/409 |
| 6,397,522 | B1 * | 6/2002 | Nussbaum | 49/127 |
| 6,553,715 | B1 * | 4/2003 | Lonnberg | 49/127 |
| 6,571,855 | B1 * | 6/2003 | Goldsmith et al. | 160/199 |
| 6,581,345 | B2 * | 6/2003 | Goldsmith et al. | 52/243.1 |
| 6,715,530 | B2 * | 4/2004 | Goldsmith et al. | 160/199 |
| 7,260,916 | B2 | 8/2007 | Sarnell et al. | |
| 7,637,177 | B2 | 12/2009 | Haab et al. | |
| 8,046,872 | B2 * | 11/2011 | Burgess et al. | 16/97 |
| 2001/0011583 | A1 * | 8/2001 | Spork | 160/199 |
| 2010/0154174 | A1 * | 6/2010 | Haab et al. | 16/96 R |

* cited by examiner

*Primary Examiner* — Brian Glessner
*Assistant Examiner* — Adam Barlow
(74) *Attorney, Agent, or Firm* — Oliff PLC

(57) ABSTRACT

The foldable sliding wall includes at least a first and a second wall element that are pivotally connected to one another and pivotally held by a first and a second head carriage, which are displaceably supported in a head rail. A first head fitting is mounted at the upper side of the first wall element and is connected to a first shaft, which is supported in a first carriage body of the first head carriage and a second head fitting is mounted at the upper side of the second wall element and is connected to a second shaft, which is supported in a second carriage body of the second head carriage.

15 Claims, 14 Drawing Sheets

FOLDABLE SLIDING WALL AND CARRIAGE

BACKGROUND OF THE INVENTION

The invention relates to a foldable sliding and to a carriage for this foldable sliding wall.

In order to separate or form rooms or room areas, for closing room openings or window openings and for covering fronts or facades often wall elements, such as sliding doors are used, which are mounted, possibly mounted so as to be rotatable, on carriages that are displaceable along a rail. Sliding doors of this kind are made for example from transparent glass, wood or metal. Often, the wall elements are coupled with one another, so that the combination of all elements forms a foldable sliding wall or a folding sliding shutter. Individual wall elements or a plurality of wall elements combined with one another are also used in furniture units, particularly in wardrobes.

In [1], U.S. Pat. No. 6,397,522B1, a sliding-rotating leaf system is disclosed that serves for enclosing a balcony with glass and that comprises several sliding-rotating wall elements, which are supported each with two rollers and which are movable separated from one another along a guide rail that is provided with coupling elements, which can be bought into engagement with a coupling piece provided on top of the sliding-rotating leaves that can be rotated as soon as a coupling piece is engaged in a coupling element and one roller is decoupled from the rail.

In [2], U.S. Pat. No. 7,260,91662, a further sliding-rotating leaf system used for glazing balconies is disclosed with sliding-rotating leaves that are also supported with two rollers and are movable separated from one another along a guide rail towards a coupling element, where the sliding-rotating leaves are rotated by completely decoupling one of the rollers from the rail.

In [3], U.S. Pat. No. 6,301,833B1, discloses a clamping or coupling device for sliding-rotating leaf systems as disclosed in [1] and [2].

In [4], U.S. Pat. No. 6,286,258B1, a movable wall is disclosed that comprises two sets of guide rails, along which the wall elements can be moved into a parking region. The guide rails comprise a branch in the parking region, from which a straight rail element and a bent rail element are leaving. Each of the wall elements is suspended on two carriages, of which one is guided into the straight rail element and the other into the bent rail element. By this, the wall elements are turned by 90° and for example parked aligned in parallel to one another on a wall. Hence, for turning the wall elements a dedicated rail system is required, which possibly needs to be adapted to the local conditions.

From [5], product catalogue of HAWA AG, "*Baubeschläge für Faltschiebeläden*" ["Structural fittings for folding sliding shutters"], 2006, page 36, a fitting for folding sliding shutters having an even or uneven number of wings, is known, which are installed for example on a window front or on the outer side of a balcony. The wing elements of the folding assembly are pivotally connected with one another by means of hinges. Such a folding assembly can be pushed laterally against a wall or used free standing as a light shield or wind shield. The displacement, opening or folding of the folding assembly, is realised without an additional rail element through manual intervention. The wing elements are thereby normally rotated at unequal speeds with the result that irregular folding processes arise in dependence upon the manual intervention.

From [6], US2010154174A1, a foldable sliding wall is known which comprises motorized carriages that are mounted on the front first wall element and on each following wall pair of wall elements. The motors of the carriages are thereby controlled in such a manner, that they travel with the required speed along the rail. Further, the motors are coupled with a drive element with which, the pivotally held wall elements can be driven, so that a wall element held by the carriage is not only moved with the required speed along the rail, but can also be turned, in order to perform the parking procedure. This device requires a plurality of motorised carriages, which comprise an extended drive mechanism and an appropriate control circuitry.

SUMMARY OF THE INVENTION

It is to be noted, that a foldable sliding wall, which is used in the front region e.g. of a building, is exposed to strong wind forces. Thereby annoying noises can be caused by known devices.

The present invention is therefore based on the object of creating an improved foldable sliding wall with at least two wall elements, which can be operated manually or by means of a drive device. Further a carriage shall be defined for such a foldable sliding wall.

It shall be possible to operate the foldable sliding wall with only one motorised carriage, so that a minimum effort results for driving and controlling the foldable sliding wall.

It shall be possible to sequentially fold the elements of the foldable sliding wall, so that only the wall elements can be turned and parked, which are not required, while the required wall elements remain fully functional.

The device shall have a simple construction also in the parking region and shall not comprise further rail elements.

The individual wall elements shall be held stable, so that under the impact of wind scarcely noise and only a minimal mechanical stress on the device parts results.

The inventive carriage shall require little space only, so that it can be displaceably supported, as carriages that are already known, within a correspondingly adapted rail.

Further, it shall be possible to firmly hold and lock the wall elements in the parking room without additional drive means.

This object is achieved with a foldable sliding wall and a carriage, which exhibit the features defined in claims 1 and 15. Preferred embodiments of the invention are defined in further claims.

The foldable sliding wall, which serves for closing an opening, e.g. an opening of a building, comprises at least a first and a second wall element that are pivotally connected to one another and that are pivotally held by a first and a second head carriage, which are displaceably supported in a head rail. A first head fitting is mounted at the upper side of the first wall element and is connected to a first shaft, which is supported in a first carriage body of the first head carriage and a second head fitting is mounted at the upper side of the second wall element and is connected to a second shaft, which is supported in a second carriage body of the second head carriage. Said first head fitting comprises a first lever that is connected to the first shaft, which is a rotor shaft and said second head fitting comprises a second lever that is connected to the second shaft, which is a holding shaft, said head rail comprises a rotor channel with at least one coupling member having at least one rotor chamber, and said rotor shaft is holding a rotor, which, if aligned in parallel to the head rail, is transferable within the rotor channel, and which, if aligned perpendicularly to the head rail, is arrested in the rotor chamber.

In a first embodiment the coupling member is formed in one piece on the rail or on a coupling member body that is connected in one piece to the rail. The coupling member extends along the parking region or along the whole rail.

In a second embodiment the coupling member is formed on a coupling member body that can be inserted into a mounting channel provided within the rail.

If more than one parking region is provided, a plurality of guide bodies can be provided. As required the guide bodies can be mounted on both sides or on one or the other side of the rotor channel. This embodiment allows to turn a wall element to one or the other side and to secure the ball element against movements in the one or the other direction or in both directions.

The rotor channel can be free or can the delimited by means of profile elements of the rail or by said coupling member body that is inserted into the rail or connected in one piece to the rail. In principle the rotor channel forms a real or virtual channel within the rail, which is held free for the transfer of the rotor or the rotors respectively.

The rotor chambers can be designed with bores that are introduced into the coupling member body that forms part of the rail and that preferably comprises two parts. Hence, the rotor chambers preferably form cylindrical openings or segments thereof. In preferred embodiments, in which the wall elements are turned in one direction only, an asymmetrical coupling member body is preferably provided only on one side of the rotor channel. If the parking region lies at the end of the rail and the wall elements are all turned in the same direction there by 90°, then it is sufficient, to provide rotor chambers, which provide space for a 90° turn.

Hence, the rotor can be formed accordingly, symmetrically or asymmetrically, and can be provided with at least one rotor head, which can slide or all along the wall of the rotor chamber or along the coupling member. Transitions within the coupling member or between the rotor chamber and the rotor channel are preferably free of edges, so that stresses of the rotor head can be avoided. If the related carriage needs to be secured against movement in the one and the other direction, the rotor comprising both sides a rotor head, that can be guided along a related coupling member.

Preferably a plurality of wall elements is provided, which for example every second wall element is firmly connected to a rotor shaft holding a rotor. In preferred embodiments at least one of the carriages holds a rotor shaft and a holding shaft that are each connected to a wall element.

With the inventive foldable sliding wall any opening can advantageously be opened and closed by a plurality of wall elements, preferably pairs of wall elements. The number of operated wall elements is limited only by the available drive force provided manually or by a motor. It is particularly advantageous, normally only one motorised carriage is required. With high number of wall elements it is also possible, after a number of not motorised carriages to include a motorised carriage again. For example, openings, which connect two rooms within a building, can be closed completely or partially. Further building fronts and facades can advantageously be covered and protected by means of the inventive foldable sliding wall.

The wall elements can be transferred manually or by means of a drive device into the parking region, until the rotor of a carriage reaches the related rotor chamber and the carriage is stopped. Subsequently the wall element with the rotor that is firmly held above the rotor shaft is turned. The symmetrical or asymmetrical rotor is then aligned perpendicularly to the rotor channel, so that the rotor shaft is held stationary but rotatable within the rotor chamber. Typically the wall element is turned up to 90° around the rotor shaft and preferably aligned perpendicularly to the rail. The next wall element, which is connected via a hinge with the former wall element is pulled closer and is turned as well around 90° in reverse direction. Therefore, each wall pair of wall elements, to which a rotor is assigned, is stopped and folded when reaching the rotor chamber. Pairs of the wall elements of the foldable sliding wall are therefore sequentially turned and parked. While a wall pair of wall elements is folded, the further wall elements, which have not yet reached the parking region, remain aligned in a plane and are therefore fully functional. The foldable sliding wall can therefore cover only a part of an opening or a building front.

Upon request of the user, rotor chambers can not only be provided in the parking region, but on any other position of the rail, so that the at least a wall pair of wall elements can be parked at any desired position.

In a preferred embodiment a foot rail is provided, in which foot carriages are guided, which are connected on the lower side to the related wall elements via connecting shafts, that are each coaxially aligned with the related rotor shaft or the holding shaft, that are held by the head carriages that are guided in the head rail. The wall elements are therefore optimally guided on the upper side and the lower side and are rotatable around axes that are precisely defined.

The foldable sliding wall comprises a front carriage connected to the front sided wall element as well as one or more adjoining central carriages, which are holding each a rotor shaft and a holding shaft connected to related wall elements. Each central carriage requires only one rotor, which is connected to the rotor shaft and which serves for holding the carriage in the parking region.

For the front carriage that is preferably provided with a drive device only a holding shaft but not a rotor shaft is provided.

In a particularly preferred embodiment also to the end wall element is connected to a carriage, namely an end carriage and is not connected for example by means of a hinge to a wall or to a terminating profile. Preferably, also this end carriage is provided with a rotor shaft and can therefore be held in the parking region by means of the related rotor, until the related wall element is aligned in parallel to the rail. This has the advantage, that all wall elements can be operated and stabilised in the same manner. This is particularly significant, if the wall elements, after alignment in parallel to the rail, are locked as described below and for this purpose perform a short lock drive.

As mentioned, the central carriages are connected via a rotor shaft and a holding shaft to an end of neighbouring wall elements. Since the ends of neighbouring wall elements are turned against one another, each of the central carriages holds preferably a protection profile between the ends of the neighbouring wall elements. The protection profile preferably exhibits concave surfaces on both sides, along which the ends of the wall elements can be turned in a small distance. By this, manual intervention between the ends of the wall elements can be prevented. Preferably, also the front carriage and the end carriage are each provided with a terminating profile, which on the related wall or in a related receiving profile can enter a recess in such a way, that a tight seal results.

In a further embodiment a stabilising rail is connected, preferably integrated into the head rail. The stabilising rail comprises at least one passage for a guide cam that is mounted on top of a related wall element and that can enter through the passage into a stabilising channel, when the wall element is turned with the rotor held in place within the rotor chamber.

Here, the fact is utilised, that the wall element is precisely rotated about the rotor axis, which is preferably coaxially aligned to the hollow cylindrical rotor chamber, and the guide cam can precisely enter the passage in the stabilising rail. Optionally a guide element is assigned to the passage, along which the guide cam is guided into the passage.

After the guide cam has been introduced into the stabilising rail, the upper edges of the related wall elements, i.e. the upper edges of the wall elements that are connected with one another by means of hinges, are not only held by the rotor shafts and the holding shafts but are also held stable by the guide cam. Forces, for examples wind forces, acting on the wall elements are therefore absorbed by the guide cam, which is preferably arranged in the vicinity of the hinges, so that the neighbouring wall elements are firmly held at both ends by the carriages and the guide cam. However, if a wall element reaches the parking region when the foldable sliding wall is opened, then the related rotor is again held and rotated within the related rotor chamber. The rotor shaft is held again in such a way, that the guide cam, which exhibits a constant distance to the rotor shaft, is in the position of the passage of the stabilising rail and can exit out of the passage.

The guide cam is positioned on the top edge of the wall element in such a way, that it can travel precisely within the stabilising rail, when the wall element is aligned in parallel to the head rail. The stabilising rail can have a simple design and can exhibit for example a U-profile that is opened downwards. This U-profile and therefore the stabilising rail can also be integrated in one piece into the head rail.

In order to precisely hold the trailing wall element when it is aligned in parallel to the head rail, the trailing wall element is preferably also provided with a guide cam that can enter a passage in the stabilising rail. In order to prevent the guide cam from exiting out of the stabilising rail again, the end carriage can drive at least a minimal distance. The drive distance of the end carriage can be limited to a few centimeters but can be extended if further space for parking the wall elements would be required. The carriage body of the end carriage can be provided with a groove with the length of 2-3 centimeters, into which an arresting element engages that is connected to the head rail.

In a further preferred embodiment a support cam is provided at the upper edge of the wall elements, which abuts the outside of the stabilising rail in that fully folded and/or fully unfolded state of the wall elements. In each state the wall elements are therefore that the lies in addition by the support cam. The guide cams and the support cams therefore stabilise the wall elements, thus completely neutralising outer impacts, for example forces caused by wind. For this reason, when operating the foldable sliding wall, a noise reduction results as well as a load reduction of the device parts of the carriages, particularly the rotor shaft and the rotor. Outside of the rotor chamber the rotor therefore always remains aligned in parallel to the rotor channel, so that the rotor shaft is not required to absorb any torque.

In the parking region the carriages are stopped sequentially on defined positions, on which the related rotor is coaxially aligned with the related rotor chamber. After complete parking of the foldable sliding wall all rotors are located in the related rotor chamber and are turned by a maximum of 90° relative to the rotor channel. The carriages are thus blocked and cannot be moved.

The positions of the carriages in the parking region are preferably defined each by a stop, which is firmly or detachably connected to the head rail or is constituted by an element, such as the carriage body of a carriage that has already entered the parking region. The stop is defined in such a way, that each carriage provided with a rotor is stopped in the position, where the rotor has entered the related rotor chamber. In a preferred embodiment the bodies of the carriages are designed in such a way that they themselves form the required stop. In the parking region the carriages are driven against one another until the carriage bodies abut one another. The preceding carriage forms therefore the stop for the next carriage. The dimensions of the carriage bodies and the distances of the rotor chambers need to be adapted to one another in this case.

The rotor shaft and the holding shaft are connected to a wall element each by means of a fitting that comprises a lever, with which the rotor shaft and the holding on the one hand and the first and the second wall elements, when aligned, on the other hand are held ideally in parallel planes distant from one another. The wall elements are therefore held by the fitting levers in a sufficient distance apart in front of the head rail, so that they can be turned by applying an available force to the wall elements, when they are aligned in parallel to the head rail. The force applied in parallel to the rail onto one of the carriages preferably the front carriage or the leading wall element creates a torque on the fittings with which the wall elements are automatically turned when they reach the parking position. The fitting levers are selected in such a way that a single motorised carriage, preferably a motorised from carriage, or manual force applied to the leading wall element is sufficient to displace and turn the wall elements, i.e. to open and close the foldable sliding wall. Preferably the fitting levers are aligned perpendicularly to the wall elements and hold the wall elements a lever stroke apart from the rotor shaft and the holding shaft. The selected lever stroke is dependent primarily on the available force and the weight of the wall elements and is preferably in the range of 2-10 centimeters. Good results are achieved in various configurations with a lever stroke of 4-5 centimeters.

The head rail provided with the rotor channel and the rotor chambers as well as the carriages provided with the rotor shafts can otherwise conventionally be constructed. The carriages are provided with running elements and guide elements, such as carriage wheels or gliding elements, which can be guided along support surfaces or running surfaces provided in the rail. The rail preferably comprises two side members and a central member, which at least partly form a rectangular cross-section. The rotor channel is located preferably immediately below the central member and can laterally be delimited by profile elements. The rotor shafts are preferably vertically aligned, so that the rotor is rotatable in a plane that is aligned perpendicularly to the wall elements. The support surfaces for the carriage wheels are preferably provided on the side members of the rail. A guide channel for receiving the guide wheels is however preferably integrated in the central member of the rail beside the rotor channel.

On one of the side members of the rail preferably a mounting channel is provided, in which a linear toothing is provided, in which a cog wheel of a drive unit can engage, which is integrated into the front carriage. The linear toothing can for example be a cog rail or a toothed belt made of metal or plastic. The linear toothing can also advantageously be embossed into the rail, so that the linear toothing, i.e. the cog rail and the head rail form a unity. The cog wheel and the linear toothing can advantageously be arranged in a traction channel provided in them which requires little space. Electrical energy is provided to the drive unit via supply lines that are preferably held in a cable chain. The cable chain is preferably arranged in the traction channel below the toothed belt, so that the traction channel can be used with minimal space requirement for the linear toothing, e.g. the toothed belt, the cog wheel and the cable chain.

In this manner, the motorised carriages of the inventive foldable sliding wall or of other sliding wall systems can advantageously be supplied with energy, without using additional space.

Below the invention is described with a reference to drawings. Thereby show:

DETAILED DESCRIPTION OF THE INVENTION

Figure 1:
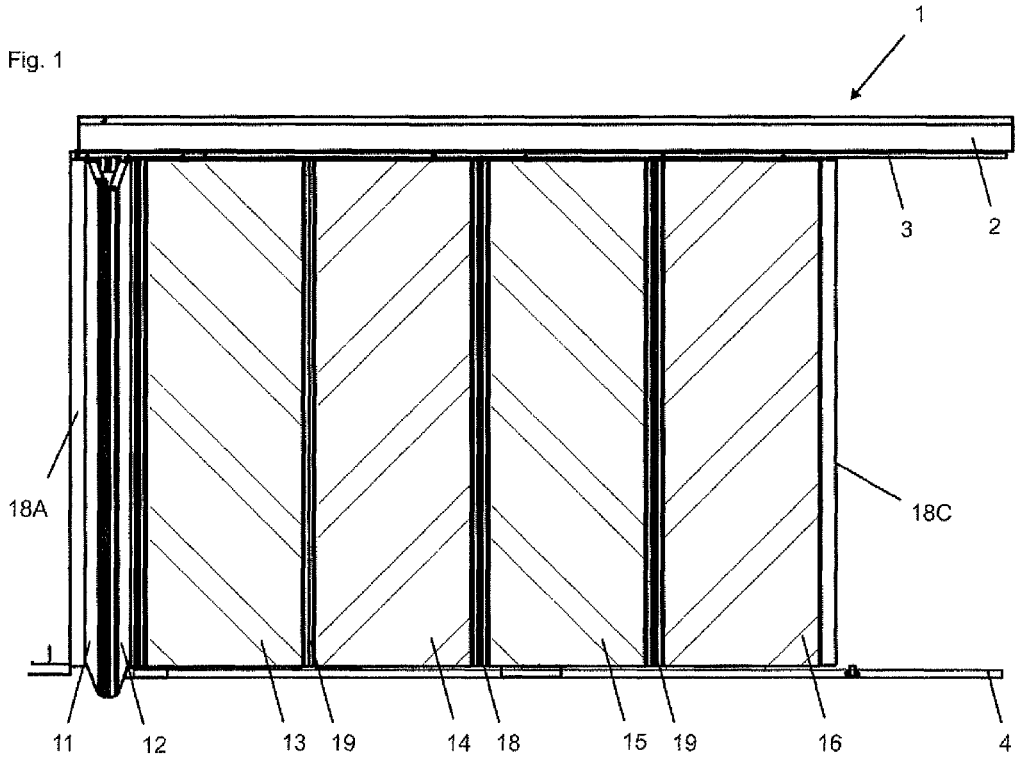
FIG. 1 an inventive foldable sliding wall 1 with six wall elements 11, . . . , 16 that are rotatable and displaceable along a head rail 2.

FIG. 1 shows an inventive foldable sliding wall 1 with six wall elements 11, 12, 13, 14, 15, 16, that are guided on the ceiling side with a head rail 2 and a stabilising rail and on the floor side with a foot rail 4. The wall elements 11, . . . , 16 form three wall pairs 11, 12; 13, 14; and 15, 16, between which protection profiles 18 are provided. The wall elements of each wall pair 11, 12; 13, 14; and 15, 16 are connected with one another on one end through a hinge 19 and on the other end held with carriages 5A, 5B, 5C (see FIGS. 3 and 4*b*), that are described below. At the front side and the end side of the foldable sliding wall 1 the corresponding wall elements 11 and 16 are provided each with a terminating profile 18A, 18C, which for example can be moved into a receiving profile.

FIG. 1 further shows that the first wall pair of wall elements 11, 12 is folded and perpendicularly aligned to the head rail 2. The process of folding the foldable sliding wall is executed sequentially, wall pair by wall pair, in the parking region, while the remaining wall elements 13, 14, 15, 16 are still alignment in a plane.

The foldable sliding wall 1 can be operated manually or also by means of a drive unit 61, e.g. an electric motor. For the operation of the foldable sliding wall, i.e. for folding and unfolding the wall elements 11, . . . , 16, the impact of force on the leading wall element 16 is sufficient, e.g. by means of a motorised carriage 5C as shown in FIG. 2.

Figure 2:
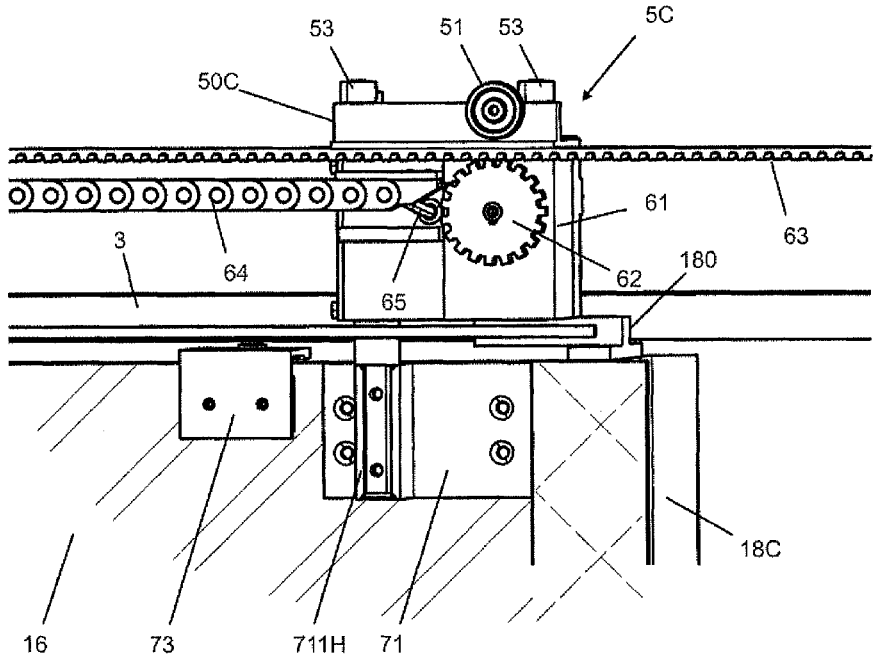
FIG. 2 a front carriage 50 that is connected to the leading wall element 16 of the foldable sliding wall 1 and that comprises a drive unit 61, which is connected to power supply lines or data lines 65 that are held within a cable chain 64 and which drives a cog wheel 62 that engages in a six belt 63.

FIG. 2 shows the motorised front carriage 5C after the removal of the head rail 2. The front carriage 5C is connected via a holding shaft 711H with the leading wall element 16.

The holding shaft 711H is held by a head fitting 71, which is mounted at the upper right corner of the wall element 16. The wall element 16 on its top with a support bracket 73, which holds a support cam 731 (see FIG. 10), that is guided along the outer side of a stabilising rail 3 (see FIG. 10).

Further, the body 50C of the carriage 5C is provided with carriage wheels 51, 52 guide wheels 53 and on the lower side with a profile holder 180, which holds a terminating profile 18C. Further, a motor 61 is integrated into body 50C of the front carriage 5C, which is connected with supply lines and, if appropriate, with data lines 65, which are fed via a cable chain 64. The motor 61 drives a cog wheel 62, which engages in a toothed belt 63 that is mounted in the rail 2.

Figure 3:
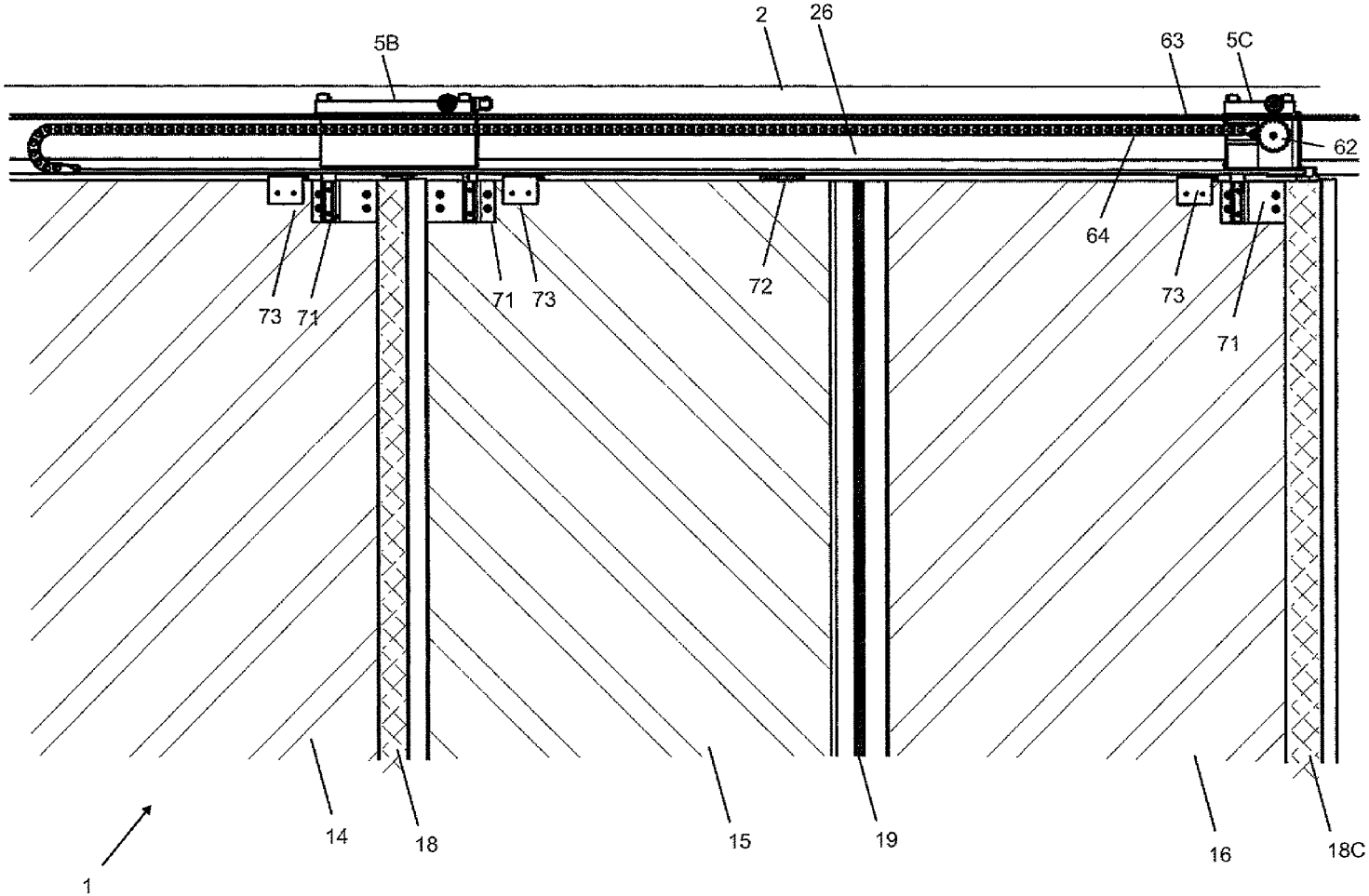
FIG. 3 the foldable sliding wall 1 of FIG. 1 with the front carriage 50 of FIG. 2 and a following central carriage 5B, which is connected with two wall elements 14, 15, between which a protection profile 18 is held.

FIG. 3 shows the foldable sliding wall 1 of FIG. 1 with the front carriage 5C of FIG. 2 and with a subsequent central carriage 5B, which holds two wall elements 14, 15 and in between a protection profile 18.

The cable chain 64 is guided directly below the toothed belt in a traction channel 26, which is held free within the head rail 2. For this purpose, the bodies 50A, 50B, 50C of the carriages 5A, 5B, and 5C are provided with corresponding recesses, i.e. with an inverted L-profile. The cable chain 64 is therefore located within the head rail 2 in the traction channel 26, which traverses the carriages 5A, 5B, and 5C. Within the traction channels 26, also the motor 61 and the cog wheel 62, which engages the toothed belt 63, are moved. The complete traction device can therefore be integrated in the head rail 2 with minimal space requirement.

In FIG. 3 it is further shown that the two wall elements 15 and 16 are connected with one another by a hinge 19 and the wall elements 14 and 15 are separated from one another by a protection profile 18.

Figure 4A:
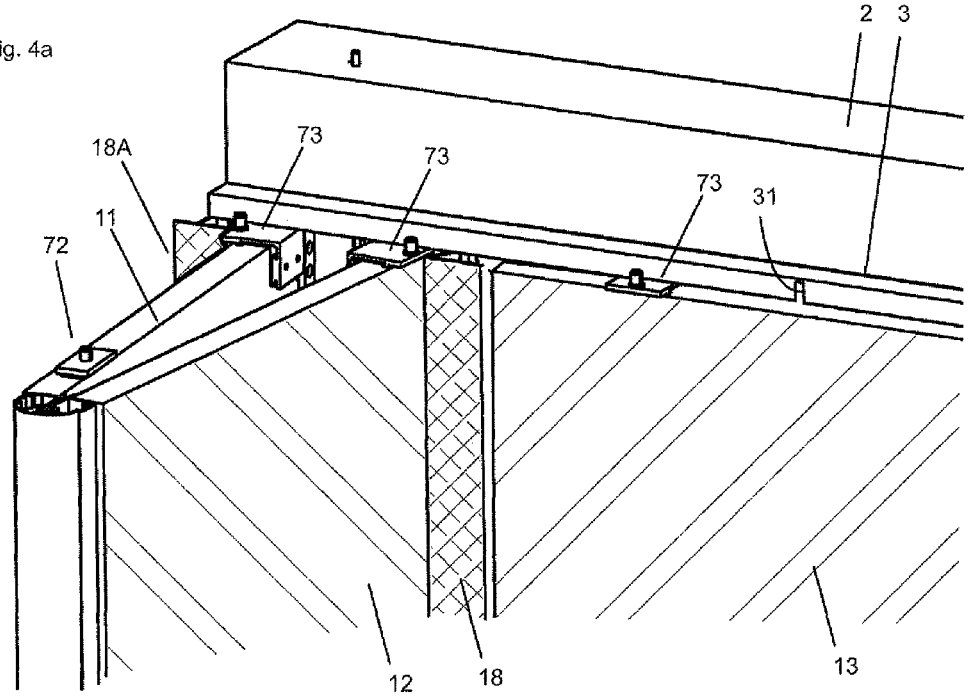
FIG. 4*a*, 4*b* the foldable sliding wall 1 within the parking region, with head rail (FIG. 4*a*) and without head rail 2 (FIG. 4*b*), with two folded wall elements 11, 12, which are held by carriages 5A, 5B that were driven towards one another.
Figure 4B:
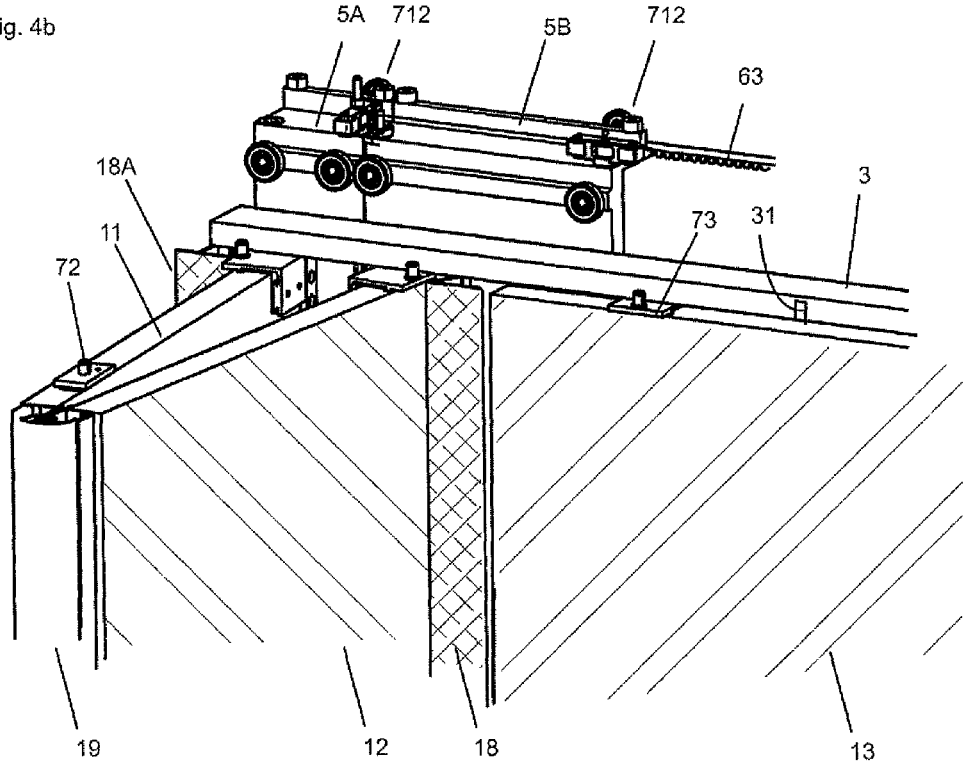

FIGS. 4*a* and 4*b* show a section of the foldable sliding wall of FIG. 1 in the parking region with two folded wall elements 11, 12, which are held by two carriages 5A, 5B that were driven against one another. FIG. 4*a* shows the foldable sliding wall 1 with the head rail 2 and FIG. 4*b* shows the foldable sliding wall 1 without head rail 2. While the first two wall elements 11, 12 or folded, i.e. aligned perpendicularly to the head rail 2, the third wall element 13 is still aligned in parallel to the head rail 2, so that a part of the opening or front is still perfectly covered. The first and the third wall element 11, 13 are connected each via a rotor shaft 711R (see FIG. 6) with the related carriage 5A; 5B. On top of each rotor shaft 711R a rotor 712 is arranged, which is firmly coupled via the rotor shaft 711R with the related wall element 11; 13 and is aligned in parallel thereto. Since the two carriages 5A and 5B have been driven against one another in the parking region, the third wall element 13 is now ready for turning, i.e. for the parking process.

Figure 5A:
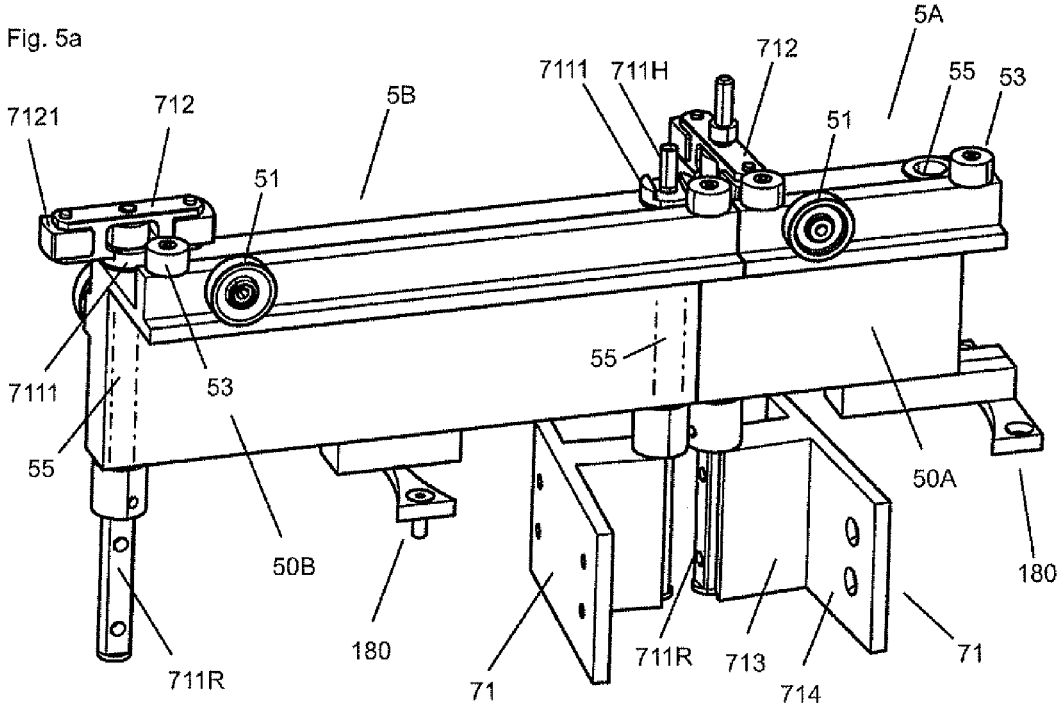
FIG. 5*a*, 5*b* from two sides the carriages 5A, 5B of FIG. 4*b*, which hold each a rotor shaft 711R that is provided with a rotor 712.
Figure 5B:
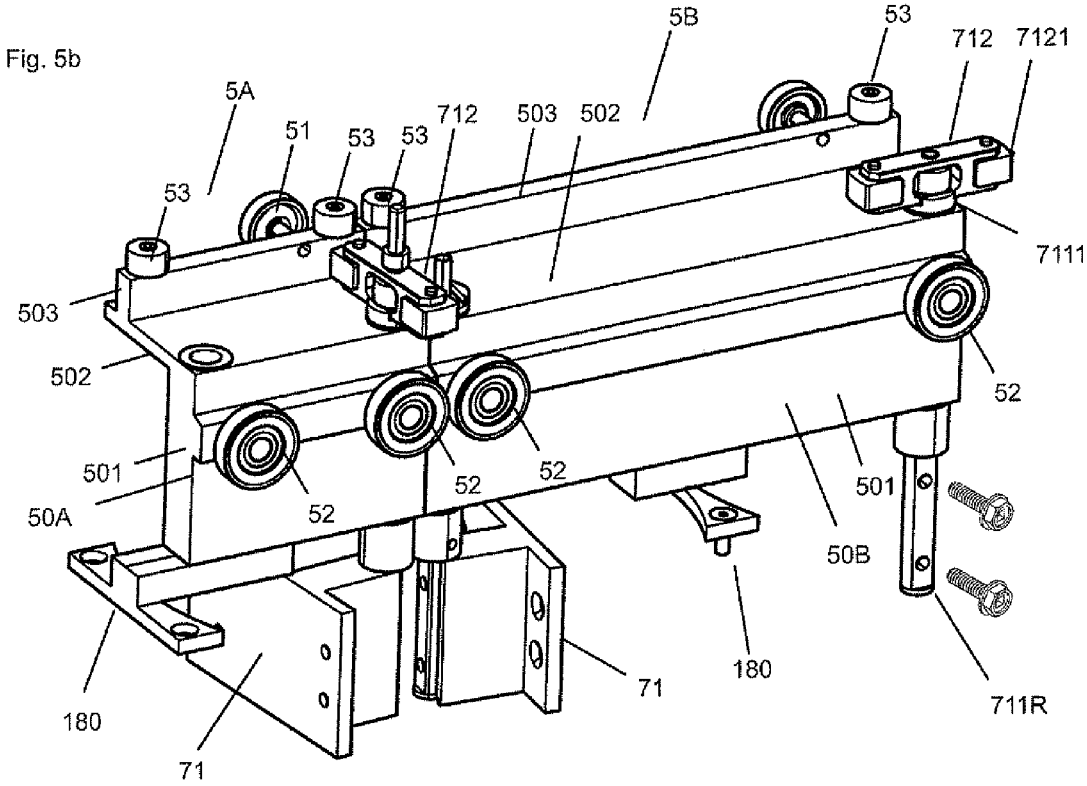

FIGS. 5*a* and 5*b* show from two angles the carriages of FIG. 4*b*, which have been driven against one another, namely an end carriage 5A and a central carriage 5B.

The two carriages 5A, 5B, which comprise a carriage body 50A, 50B each, support a rotor shaft 711R each, which are firmly connected with a wall fitting 71 each. However, only the central carriage 5B, which holds two wall elements 12, 13, is provided in addition with a holding shaft 711H, that is not equipped with a rotor 712.

The carriage bodies 50A, 50B exhibit a form of an inverted L-profile, with a first vertical profile part 501, a second horizontal profile part 502 and a third vertical profile part 503. The third profile part 503 is provided with a horizontally aligned wheel shaft holding a first carriage wheel 51 and with two vertically aligned wheel shafts holding guide wheels 53. The first profile part 501 is provided with two horizontally aligned wheel shafts holding second carriage wheels 52 and with bores 55 for receiving the rotor shaft 711R and the holding shaft 711H, which also vertically traverse the second profile part 502.

On the upper side of the rotor shaft 711R, which has been inserted into the bore 55 of the carriage body 50A or 50B, a flange element 7111 is provided, which on one side is seated on top of the carriage body 50A or 50B and on the other side is provided with a recess that receives the rotor 712 in a form locking manner. The holding shaft 711H is preferably identical to the rotor shaft 711R, but not provided with a rotor.

Figure 7:
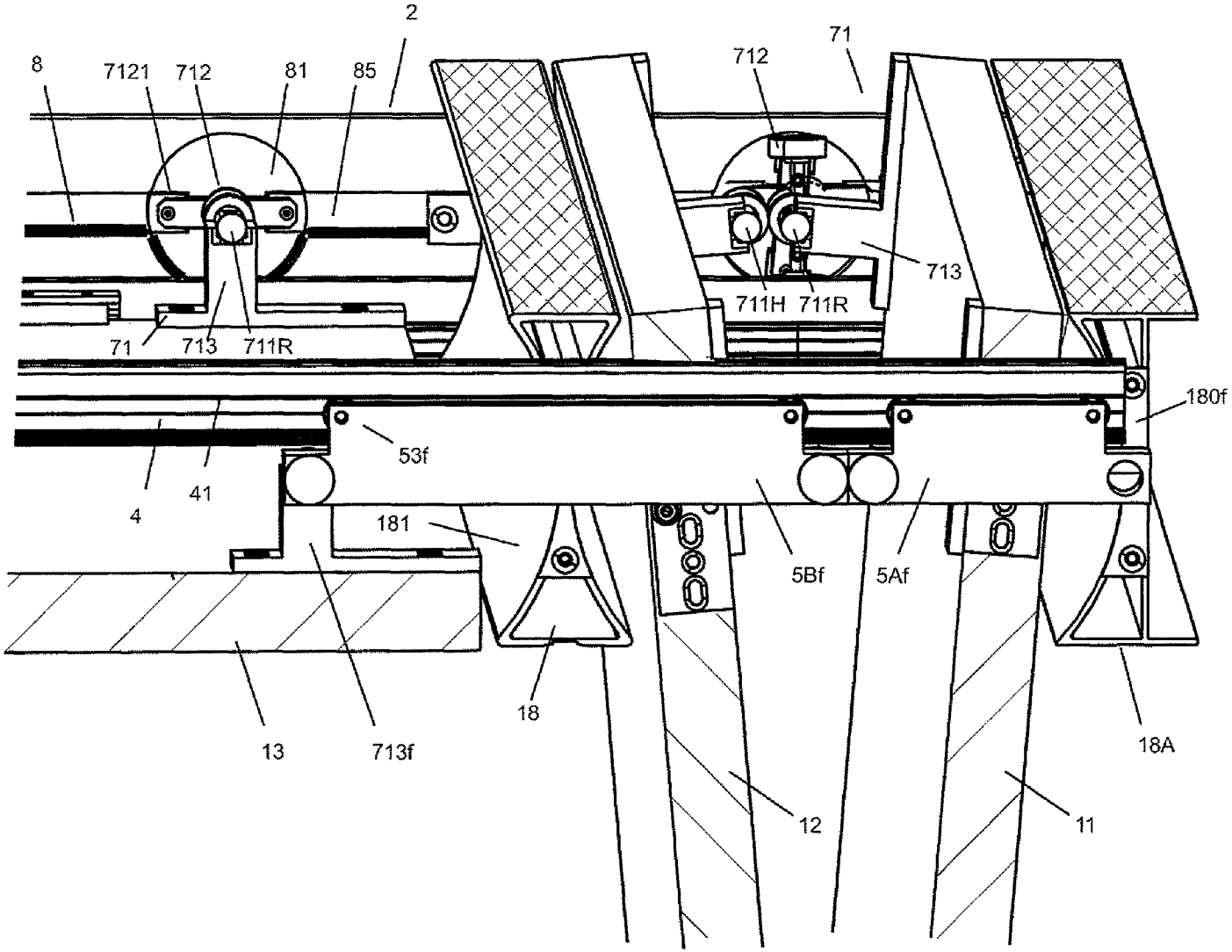
FIG. 7 the foldable sliding wall 1 of FIG. 6 seen from below with the rotors 712 of the carriages 5A, 5B (removed from the drawing), which are held each in a rotor chamber 81 provided in the rail 2.

On each front side the rotor 712 is provided with a rotor head 7121, e.g. a gliding element or a roll, which at least in the parking region runs along a coupling member 8 and can be turned out of the rotor channel 85 into the rotor chamber 81 and back, as shown in FIG. 7. Preferably, the rotor 712 is designed symmetrically and can be held in a hollow cylindrical rotor chamber 81. In this way the rotor shaft 711R is always aligned concentrically to the rotor chamber 81. However, since only a part of the rotor 712 is required for locking the related carriage, in principle, also an asymmetrical embodiment of the rotor 712 and the rotor chamber 81 can be provided. The coupling member 8, along which the active rotor head 7121 is guided, is shown in FIG. 7 with a broader line.

The wall fitting 71 comprises a fitting leave 714 that can be screwed to the wall element 11 or 13 and a fitting lever 713 that is perpendicularly aligned thereto and that is firmly connected to the related rotor shaft 711R or holding shaft 711H, e.g. by means of screws. Thereby, the fitting leave 714 and the rotor 712 of the related rotor shaft 711R are aligned in parallel to one another. With the fitting levers 713 the wall elements 11, . . . , 16 can be held in a desired distance in front of a facade. Furthermore, by means of the fitting levers 713 each a torque is realised, which act on the wall elements 11, . . . , 16 and automatically turns the wall elements 11, 16 in the parking region.

The central carriage 5B comprises a profile holder 180 between the rotor shaft 711R and the holding shaft 711H for mounting a protection profile 18 (see FIG. 6), which prevents manual intervention between the ends of the wall elements 12 and 13. However, the end carriage 5A comprises a profile holder 180 four a terminating profile 18A (see FIG. 6), which can preferably be driven into a receiving profile mounted at the edge and which then overlaps the terminating profile 18A.

Figure 6:
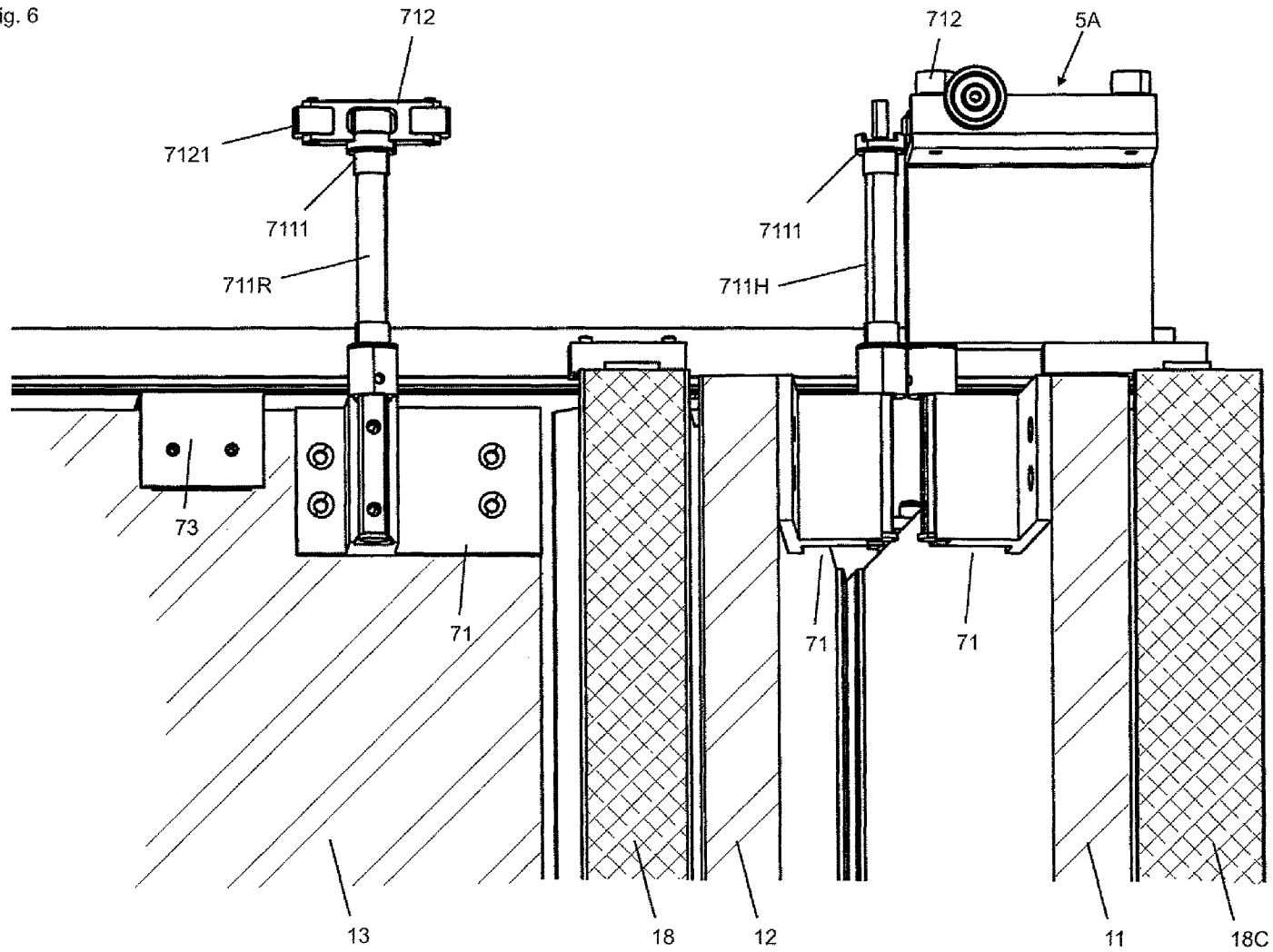
FIG. 6 the foldable sliding wall 1 of FIG. 4*b* with the partly dismantled central carriage 5*b*, i.e. the remaining rotor shaft 711R and the holding shaft 711H, which are provided each with a holding flange 7111.

FIG. 6 shows the foldable sliding wall 1 of FIG. 4*b* from the backside after partially dismantling the central carriage 5B. Only the rotor shaft 711R and the holding shaft 711H, that is identically thereto but not provided with a rotor 712 have remained. The end carriage 5A is individually shown, which comprises a rotor shaft 711R only but not a holding shaft.

FIG. 7 shows the foldable sliding wall 1 of FIG. 6 from below with the rotors 712 of the carriages 5A, 5B (not shown) held each in a rotor chamber 81 of the head rail 2. It is shown, that the rotors 712 are aligned in parallel to the related wall elements 11 and 13.

The rotor 712 of the end carriage 5A held in the rotor chamber 81 is aligned perpendicularly to the rotor channel 85 and can therefore not enter the rotor channel 85. The end carriage 5A is therefore blocked and can only be moved, when the related first wall element 11 is turned by 90° and aligned in parallel to the head rail 2.

However, the rotor 712 of the (first) central carriage 5B is aligned within the rotor chamber 81 in parallel to the rotor channel 85 and can enter the rotor channel 85. This position is reached, when the central carriage 5B has entered the parking region and has contacted the end carriage 5A or when the third wall element 13 has been removed from the parking region and has been turned back into alignment in parallel with the head rail 2. In the first case (entrance) the rotor 712 has not yet been turned within the rotor chamber 81. In the second case (except) the rotor 712 has been turned in the rotor chamber 81 into the exit position, thereafter the central carriage 5B can exit. When the central carriages 5B are exiting, only the two first wall elements 11, 12 or turned into alignment in parallel to the head rail 2, subsequently also the rotor 712 of the end carriage 50 can enter the rotor channel 85. The end carriage 5A and the related first wall element 11 therefore show the same movements as the central carriage 5B and the related wall elements 13 and 15. The significance of this is explained below with reference to FIG. 10.

FIG. 7 further shows the foot rail 4 from below with a guide channel 41 provided therein, in which guide wheels 53*f* of the foot carriages 5Af, 5Bf are guided. The foot carriages 5Af, 5Bf, which are mounted on the floor side, are connected via connecting shafts 711*f* (see FIG. 9) with foot fittings 71*f* that are attached on the floor side to the wall elements 11, 12, 13. The foot fittings 71*f* are identical to the head fittings 71 mounted on the ceiling side. The connecting shaft 711*f* held by the foot fitting 71*f* and the corresponding rotor shaft 711R or holding shaft 711H connected to the related head fitting 71 are coaxially aligned with one another, so that proper function of the foldable sliding wall 1 is ensured.

The rotor shaft 71R and the holding shaft 711H are connected via the fitting lever 713 to the wall elements 11, . . . , 16, wherefore torques act on the wall elements 11, . . . , 16, as soon as a manual force or a force generated by the drive unit 61 is exerted onto the wall elements 11, . . . , 16 in parallel to the head rail 2. By the resulting torque the wall elements 11, . . . , 16 are turned sequentially, as soon as the carriages 5A, 5B are stopped and the rotors 712 have entered the related rotor chambers 81. Before turning of the wall elements 11, . . . , 16 is prevented by the rotors 712 guided in the rotor channel 85 and preferably by a guide cam 721 guided in stabilising rail 3 as described below with reference to FIG. 10.

FIG. 7 further shows the terminating profile 18A and the protection profile 18 that exhibits two concave formed sides, along which the neighbouring ends of the wall elements 12 and 13 are guided.

Figure 8:
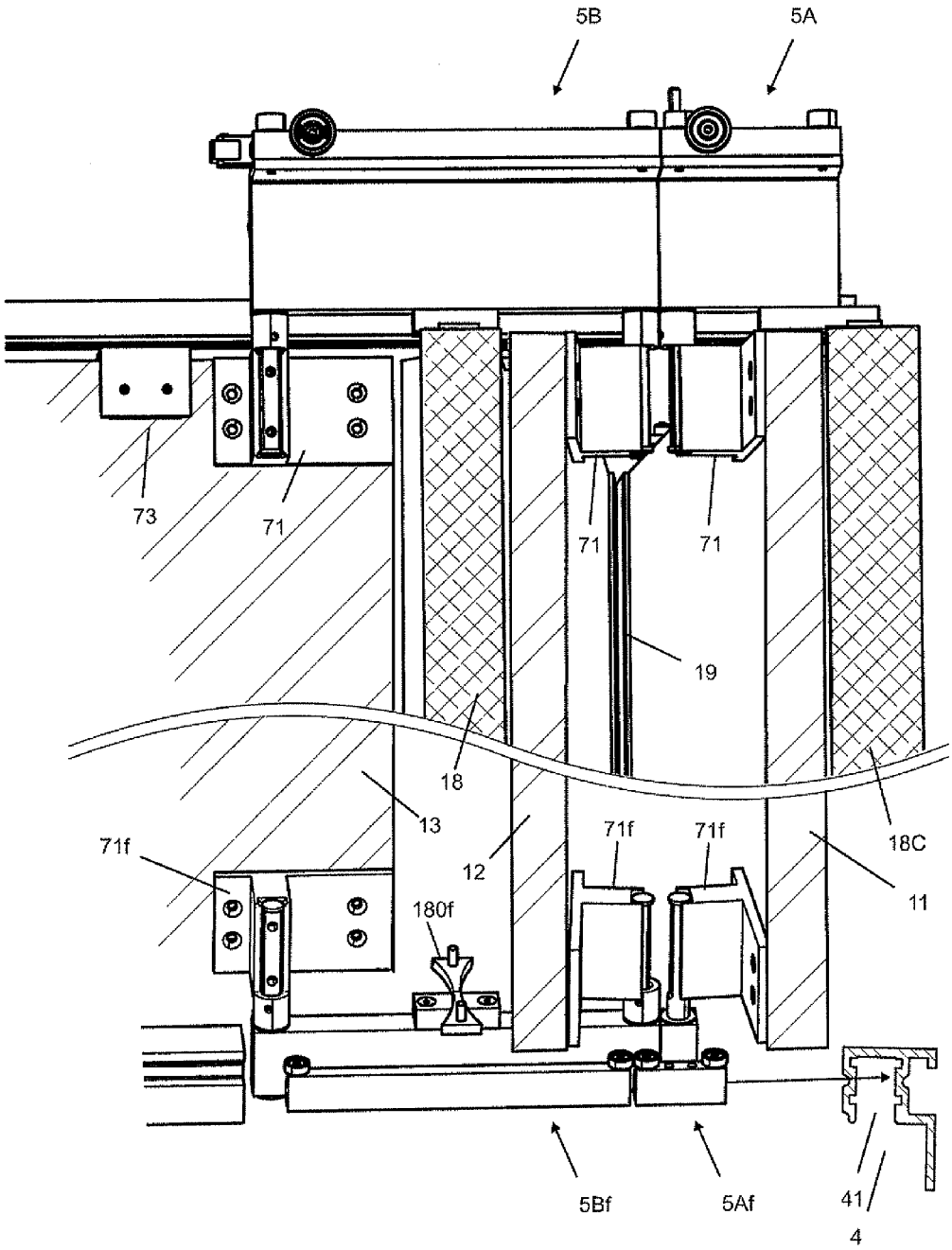
FIG. 8 the foldable sliding wall 1 of FIG. 4*b* with foot carriages 5Af, 5Bf guided in a foot rail 4.

FIG. 8 shows the foldable sliding wall 1 of FIG. 4*b* again from the backside with the head fittings 71 and the foot fittings 71*f* connected to the wall elements 11, 12, 13 and with the head carriages 5A, 5B and put carriages 5Af, 5Bf that correspond to one another.

Figure 9:
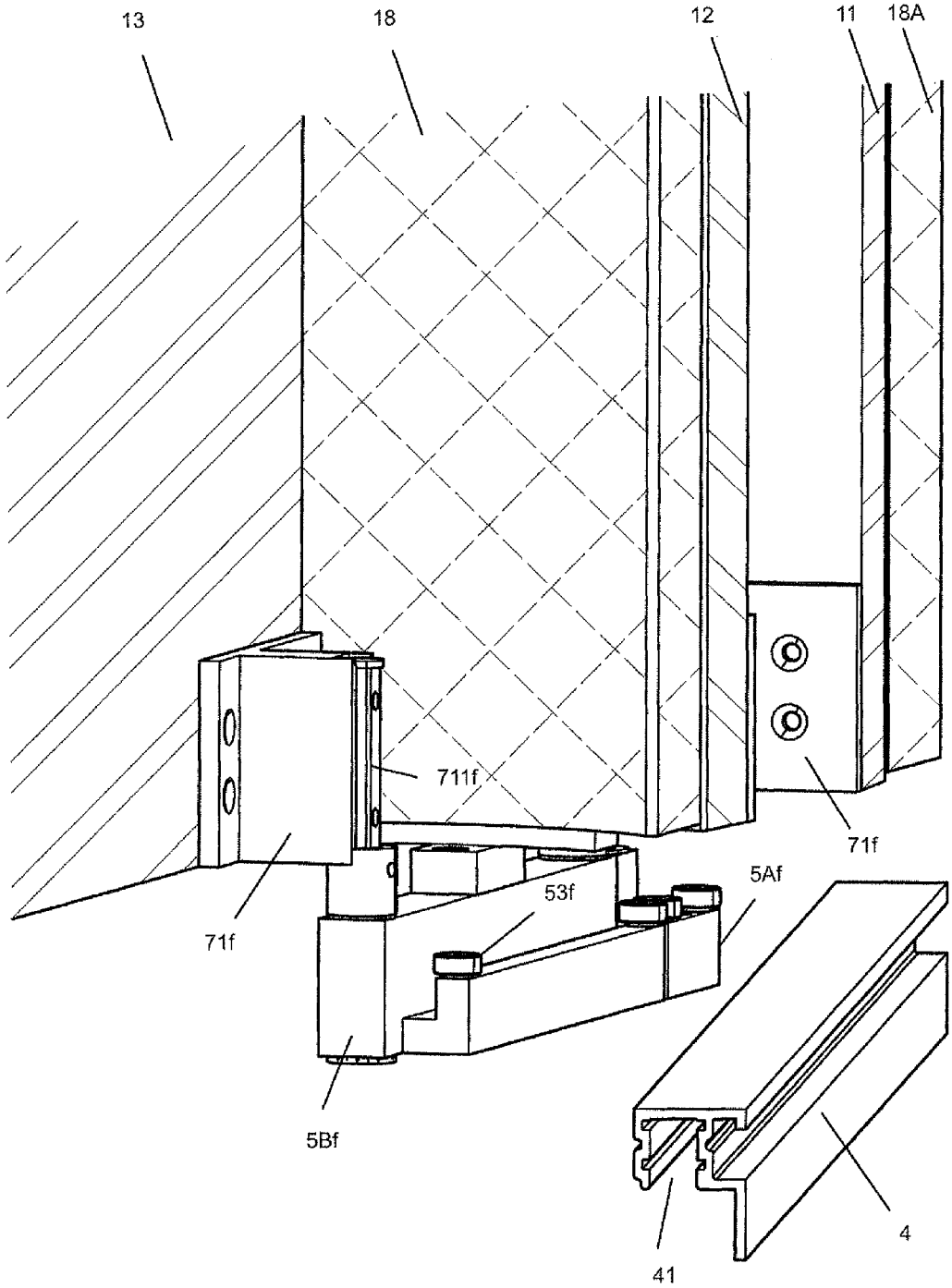
FIG. 9 in detailed view the foot rail 4 and the foot carriage 5Bf of FIG. 8, which are connected on the lower side to the wall elements 12, 13.

FIG. 9 shows the foot rail 4 and the foot carriage 5Bf of FIG. 8 in detailed view. It is shown that the bodies of the foot carriages 5Af, 5Bf each form a U-profile, which comprises a part with guide wheels 53*f* that can engage the guide channel 41 provided in the foot rail 4.

Figure 10:
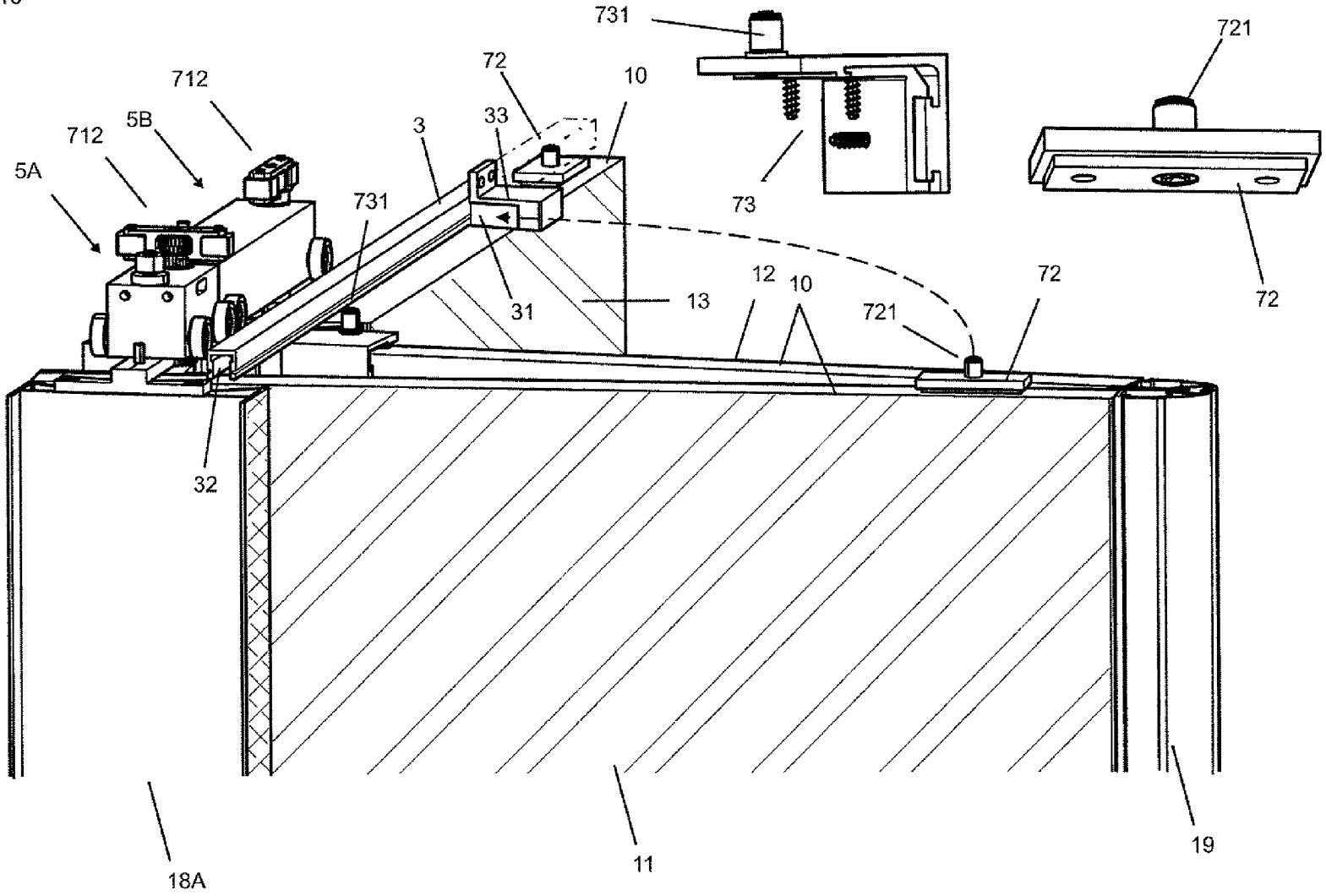
FIG. 10 the foldable sliding wall 1 with a stabilising rail 3 that comprises a passage 31, through which a guide cam 721 can pass and along which stabilising rail 3 a support cam 731 is guided, with which guide cams 721 and support cams 731 the related wall elements 11, 12, 13, . . . are firmly held in an alignment parallel to the head rail 2.

FIG. 10 shows the foldable sliding wall 1 with the stabilising rail 3 that comprises a plurality of passages 31, which provide access to the stabilising rail 3. It is further shown that on top 10 of the first and the third wall elements 11, 13 each a guide fitting 72 is mounted, which comprises a guide cam 721. Further, on top 10 preferably of wall elements 11, 12, 13 and 14 each a support bracket 73 is mounted, which comprises a support cam 731, with which the related wall elements 11, 12, 13 and 14 can be fixed in the parking position.

When closing the foldable sliding wall 1 the guide cams 721 are guided through the passage 31 into the stabilising channel and displaceable held therein. The support cams 731 are positioned in such a way, that they abut the outside of the stabilising rail 3, after the foldable sliding wall 1 has been opened and preferably also after the foldable sliding wall 1 has been closed. The stabilising channel 32 preferably comprises a U-profile which is opened downwards. Preferably a guide element 33 is provided, which guide the guide cam 721 towards the passage 31 and simultaneously lets the support cam 731 passed by. For this purpose the support cam 731 is for example embodied with smaller height than the guide cam 721. The guide cam 721 and the support cam 731 are preferably provided with rolls or gliding elements.

The process of entering the guide cam 721 mounted on top of the first wall element 11 into the stabilising rail 3 is shown in FIG. 10.

The rotor shafts 712 are held in place within the related rotor chambers 81 in defined positions, but remain rotatable, so that the wall elements 11, 12, 13, 16 are always guided along the same path when the foldable sliding wall 1 is opened or closed. The guide cam 721 mounted on top 10 of the wall elements 11, . . . , 16 therefore pass with each turning process through the related passage 31 provided in the stabilising rail 3. The constant distance between each rotor chamber 81 and the related passage 31 therefore corresponds to the constant distance between the rotor shaft 711R and the related guide cam 721.

FIG. 10 shows the rotors 712 of the carriages 5A, 5B in the alignment already shown in FIG. 7. The rotor 712 of the central carriage 5B is aligned in parallel to the rotor channel 85 and can enter into it. Hence, the central carriage 5B is unblocked and can exit, drawn from the third wall element 13. Thereby the second wall element 12 is following and thus turns via the hinge 19 the first wall element 11 around the rotor shaft 711R, which is stationary held by the rotor 712 of the end carriage 5A. The first wall element 11 therefore makes a turn until it is aligned in parallel to the head rail 2. As shown in FIG. 10, during this process the guide cam 721 passes through the related passage 31 and enters the stabilising rail 3. As soon as this is completed the rotor 712 of the end carriage 5A is aligned in parallel to the rotor channel 85 and can drive into it. Now, the end carriage 5A is also unblocked and is driving together with the first wall element 11 on a lock drive over a distance.

If the first wall element 11 shall remain at the neighbouring wall, then the drive length of the end carriage 5A, i.e. the length of the lock drive is limited to a drive length, that is required for moving the related guide cam 721 away from the passage 31 and to secure the guide cam 721 within the stabilising channels 32. However, a longer drive length may be provided in order to move the folded wall elements, i.e. the foldable sliding wall, away from the opening for example into a storage room. The drive length of the first wall element corresponds for example to the diameter of the folded wall elements, which may be stored as a package hidden in a storage area. After all but one wall elements 12, 13, . . . have been drawn out of the storage area, the trailing wall element 11 needs to be drawn out of the storage area or parking region as well. Hence, for this purpose the drive length for the trailing wall element 11 may be provided accordingly.

After completion of this process the first wall element 11 is firmly held on the one hand by the end carriage 5A and on the other hand by the guide cam 721 which is mounted in the vicinity of the hinge 19, wherefore forces are neutralised that act on the trailing wall element 11. This ensures that all wall elements 11, . . . , 16 of the foldable sliding wall 1 are optimally held and outer impacts are neutralised practicably completely.

When closing the foldable sliding wall 1 the described processes are executed sequentially for each wall pair of wall elements 11, 12; 13, 14 and 15, 16; which can freely be selected in number. For each wall pair a rotor chamber 721 is provided and preferably a passage 31 corresponding thereto in the stabilising rail 3. The head rail 2 can also be designed for a higher number of wall elements, from which only a part is used.

When opening the foldable sliding wall 1 the described processes run reverse. The rotor 712 of the carriage 5A or 5B is held in the related rotor chamber 81 and turned. The related guide cam 721 appears at the passage 31 and can exit the stabilising channel 32. The related wall element 11, 13, can no longer be displaced but turned and parked.

Figure 11:
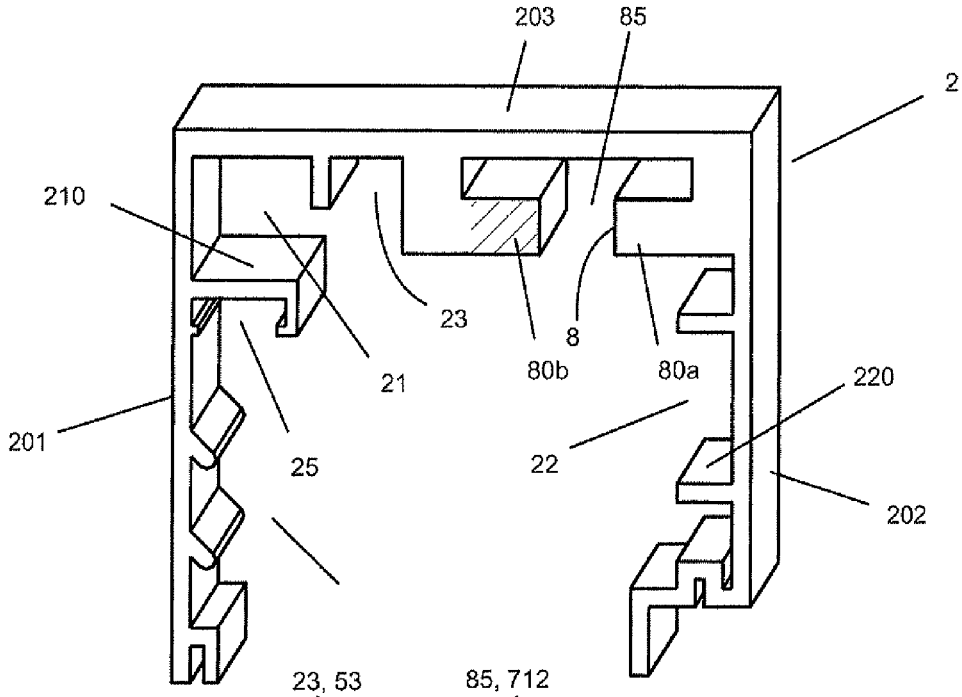
FIG. 11 a cross-sectional view of the head rail 2 of FIG. 1.
Figure 12:
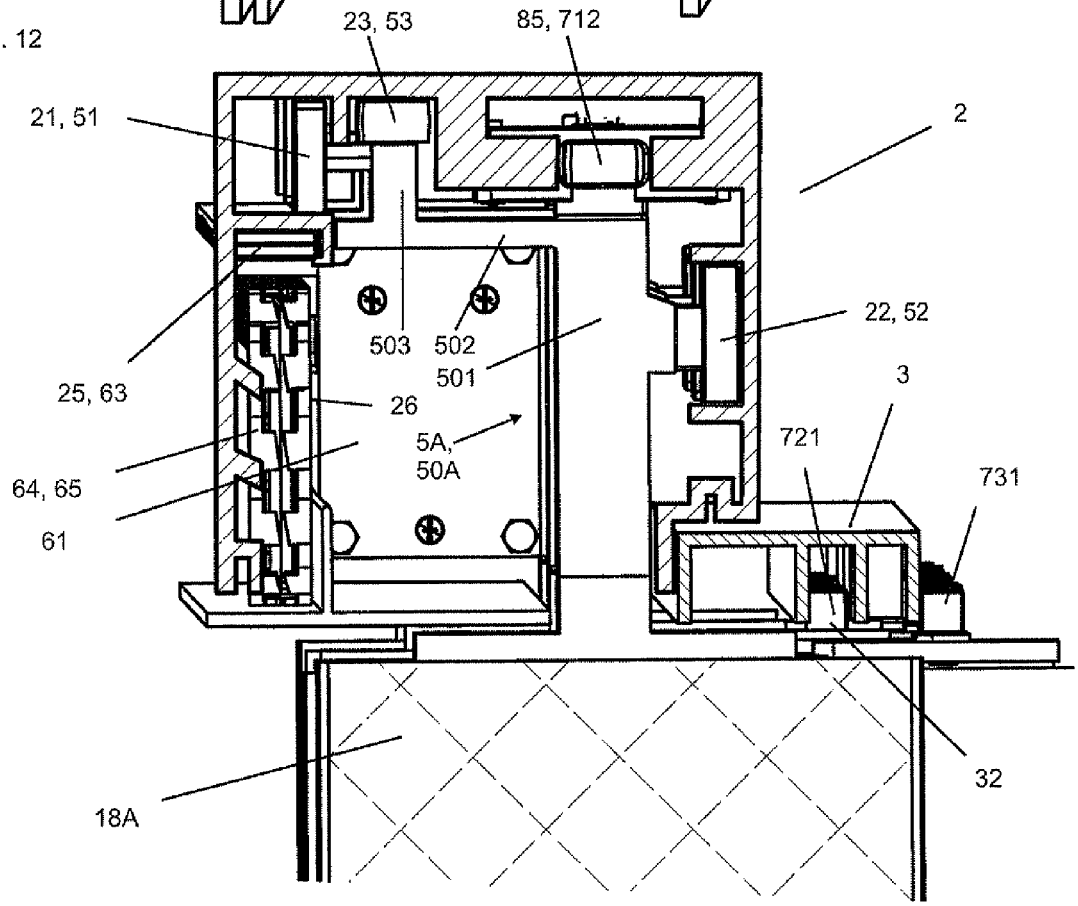
FIG. 12 a cross-sectional view of the head rail 2 and the stabilising rail 3 of FIG. 1 seen from the side of the end carriage 5A.

FIGS. 11 and 12 show each a cross-section of the head rail 2 of FIG. 1. FIG. 12 shows a cross-section of the head rail 2 and of the stabilising rail 3 von FIG. 1 from the side of the end carriage 5A.

The head rail 2 comprises a first and a second side member 201, 202, which are connected with one another by a central member 203. On the top between the first side member 201 and the central member 203 a first carrier channel 21 is provided for receiving the first carriage wheels 51. The carriage wheels 51 are supported on a supporting and holding element 210, which forms a holding profile 25 on its lower side, in which the toothed belt 63 is held. Below the supporting and holding element 210 a traction channel 26 is provided, in which the toothed belt 63, the cable chain 64 with the supply lines 65 as well as the drive wheel 62 of the drive device 61 are positioned. Due to the advantageous arrangement of the traction elements 62, 63, 64 and 65 and the traction channel requires little space. Due to the advantageous use of a cable chain 64 with supply lines 65 and/or data lines 65 arranged therein, the use of frequently used current bars is avoided. However, in principle the inventive foldable sliding wall 1 can also be equipped with current bars that are known from [7], U.S. Pat. No. 7,637,177B2. However with the advantageous arrangement of the traction elements 62, 63, 64 and 65 within the head rail 2, the embodiment with a cable chain is preferred.

Neighbouring to the first carrier channel 21, a guide channel 23 is provided in the central member 203, in which the guide wheels 53 are guided. Further below the central member 203 the described rotor channel 85 with the rotor chambers 81 is provided. It is shown, that the rotor channel 85 is delimited by symmetrically formed coupling member bodies

80*a*, 80*b*, which exhibit on the front sides each a coupling member 8. The second coupling member body 80*b* can be avoided, if the rotor 712 only interacts with the coupling member 8 provided on the first coupling member body 80*a*. Further, the first coupling member body 80*a*, which is integrated in one part into the head rail 2, can extend along the parking region only. Preferably, the rotor channel 85 is therefore delimited in partial regions of the head rail 2 on one side or both sides.

The second side member 202 comprises a second carrier channel 22 with a support element 220, on which the second carriage wheels 52 are supported.

FIG. 12 further shows the stabilising rail 3, which is open downward and which comprises the stabilising channel 32, in which the guide cam 721 are guided. The support cams 731 abut the outside of the stabilising rail 3. Hence, the closed foldable sliding wall 1 is firmly held by the guide cams 721 and support cams 731 that are held internally or externally by the stabilising rail 3.

Figure 13:
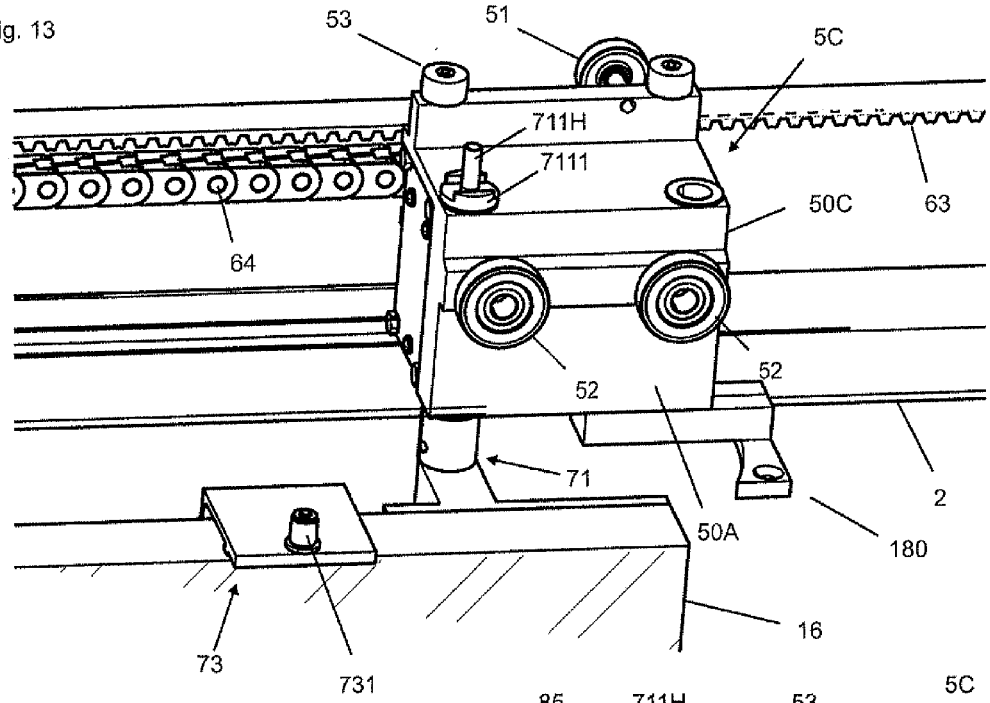
FIG. 13 the front carriage 5*c* of FIG. 2 seen from another side.

FIG. 13 shows the front carriage 5*c* of FIG. 2 seen from another side.

Figure 14:
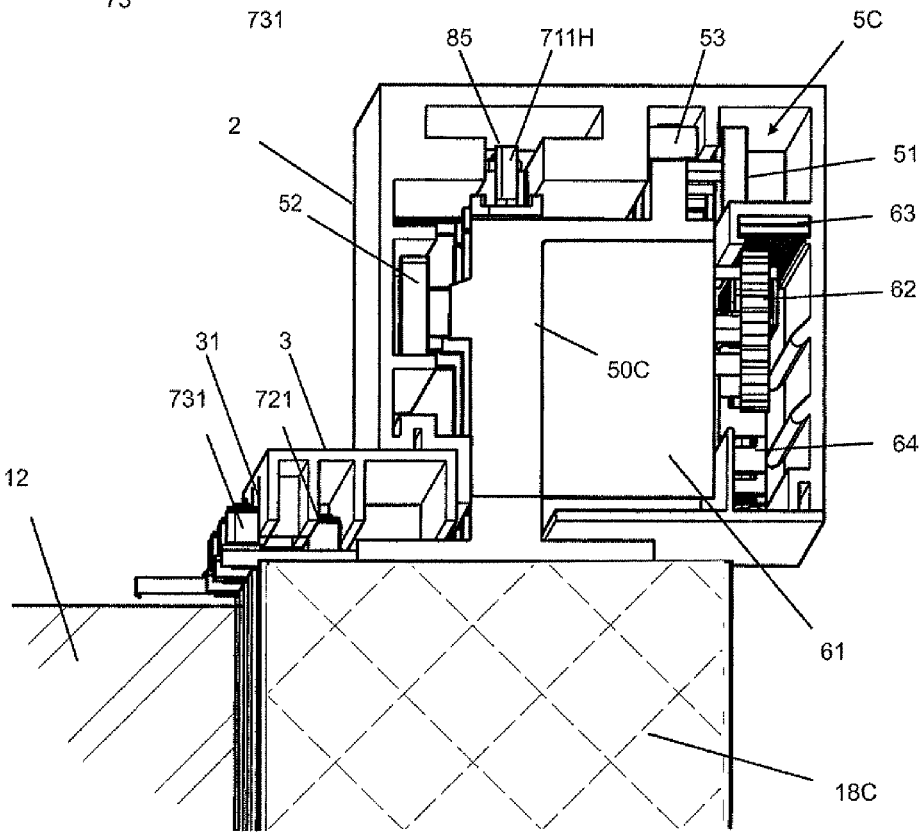
FIG. 14 a cross-sectional view of the head rail 2 and the stabilising rail 3 of FIG. 1 seen from the side of the front carriage 50.

FIG. 14 shows a cross-section of the head rail 2 and the stabilising rail 3 of FIG. 1 seen from the side of the front carriages 50.

FIGS. 12 and 14 show, that the carriage bodies 50A, 50B and 50C have an identical cross-section. The front carriage 5C differs from the end carriage 5A with the mounting of the drive device 61 and a holding shaft 711H instead of a rotor shaft 711R.

The drive device 61 preferably comprises an electric motor and a worm gearing, with which the drive wheel 62 is blocked when the electric motor is switched off. The leading wall element 16 held by the front carriage 5C is therefore firmly held when the drive device 61 is switched off.

Figure 15A:
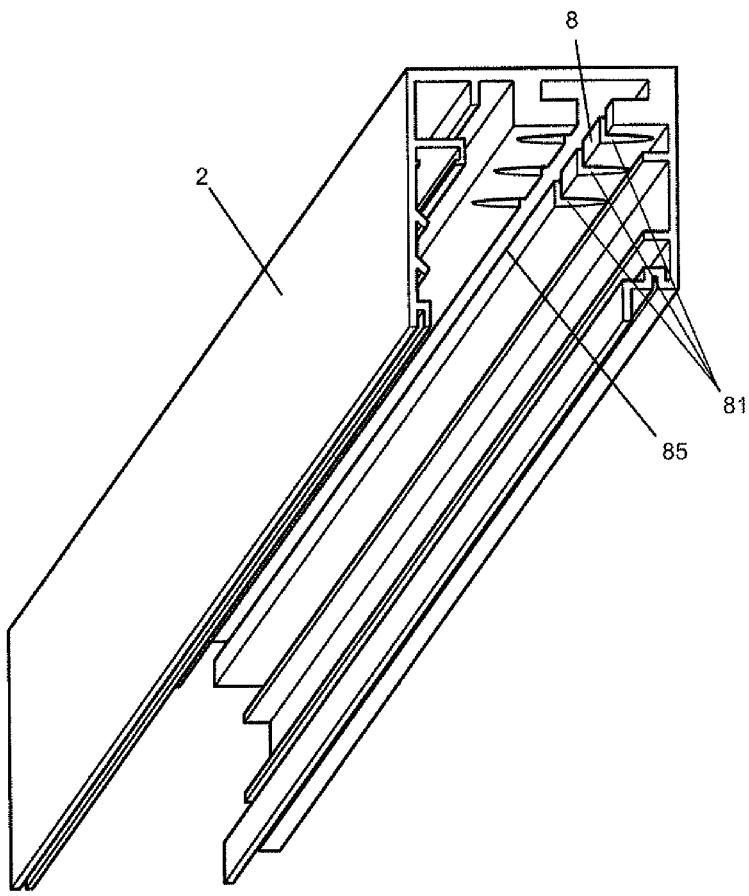
FIG. 15*a, b* different use of the head rail 2, which comprises a rotor channel 85 and rotor chambers 81.
Figure 15B:
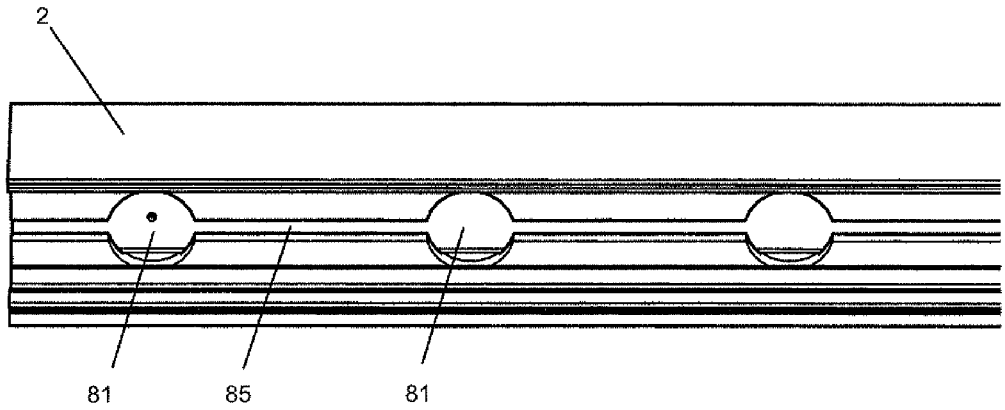

FIGS. 15*a* and 15*b* show the head rail 2 in different spatial views with three rotor chambers 81 provided therein. For the end carriage 5A and two central carriages 53 each a rotor chamber 81 is provided. All three rotor chambers 81 are occupied, then said three carriages 5A, 53 are parked adjacent to one another in the parking region.

Figure 16:
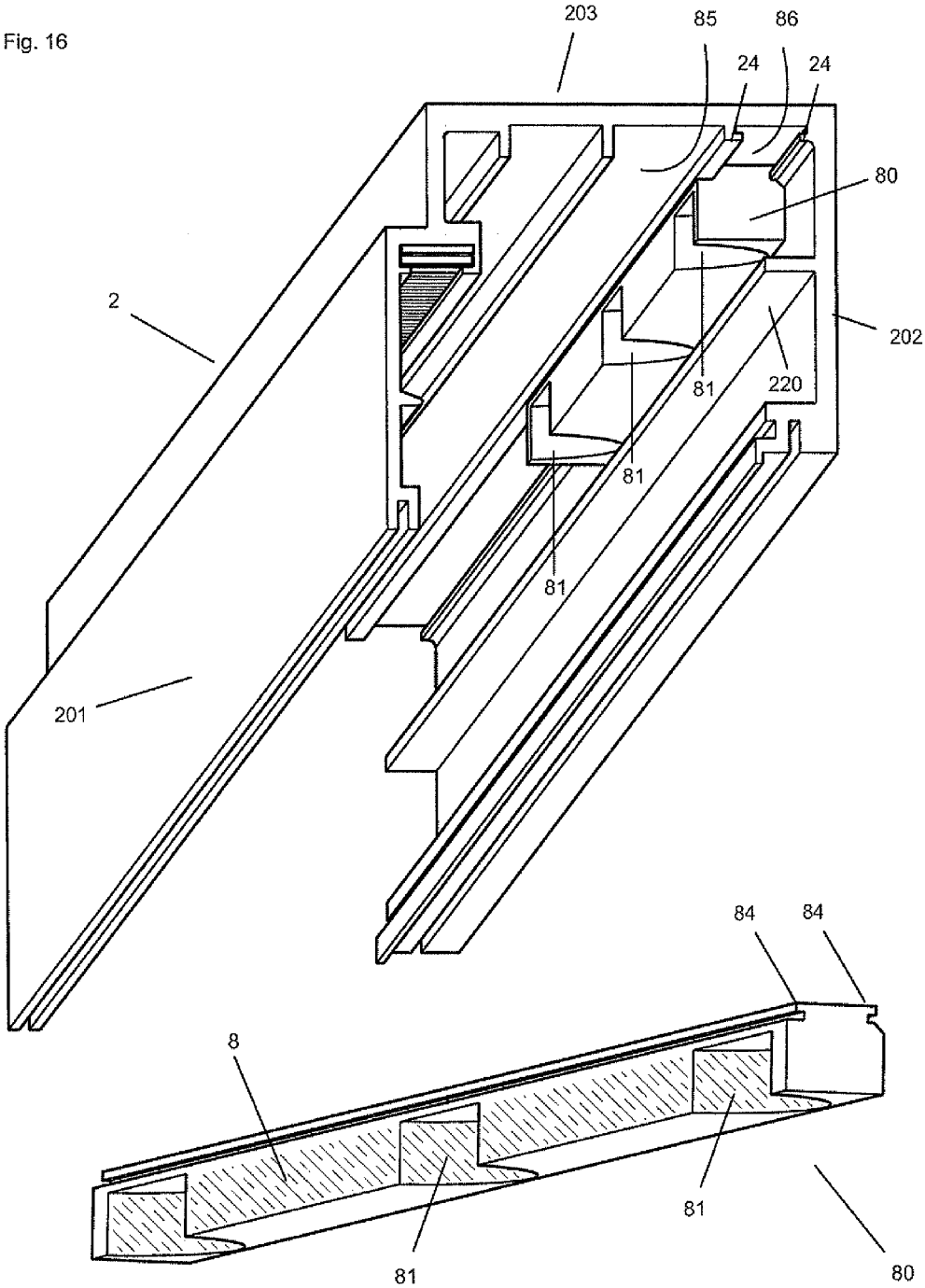
FIG. 16 a rail 2 with an embedded coupling member body 80.

FIG. 16 shows a head rail 2 in a preferred embodiment with a coupling member body 80 mounted therein, which laterally exhibits a coupling member 8 with three rotor chambers 81 and above two retaining grooves 84. The central member 203 of the head rail 2 comprises flange elements 24, which engage into the retaining grooves 84 and hold the coupling member body 80. Hence, between the flange elements 24 a mounting channel 86 is formed, into which one or more coupling member bodies 80 can be inserted and can be fixed in suitable positions for example with screws. For example screws are used that comprise a cup point on the front side, which is turned against the central member 203 of the rail 2 and anchored therein. The further shown coupling member body 80, on which the coupling member 8 is shown hatched, can also be inserted into the mounting channel 86 and can be fixed at selected positions. As shown, the asymmetrical coupling member body 80 requires little space. The rotor channel 85 can be open and without sidewalls. Hence, little space is used within the head rail 2. If desired, a mounting channel for mounting coupling member bodies 80 can also be provided on the other side of the rotor channel 85, so that coupling member bodies 80 can be installed on both sides of the rotor channel 85.

Figure 17:
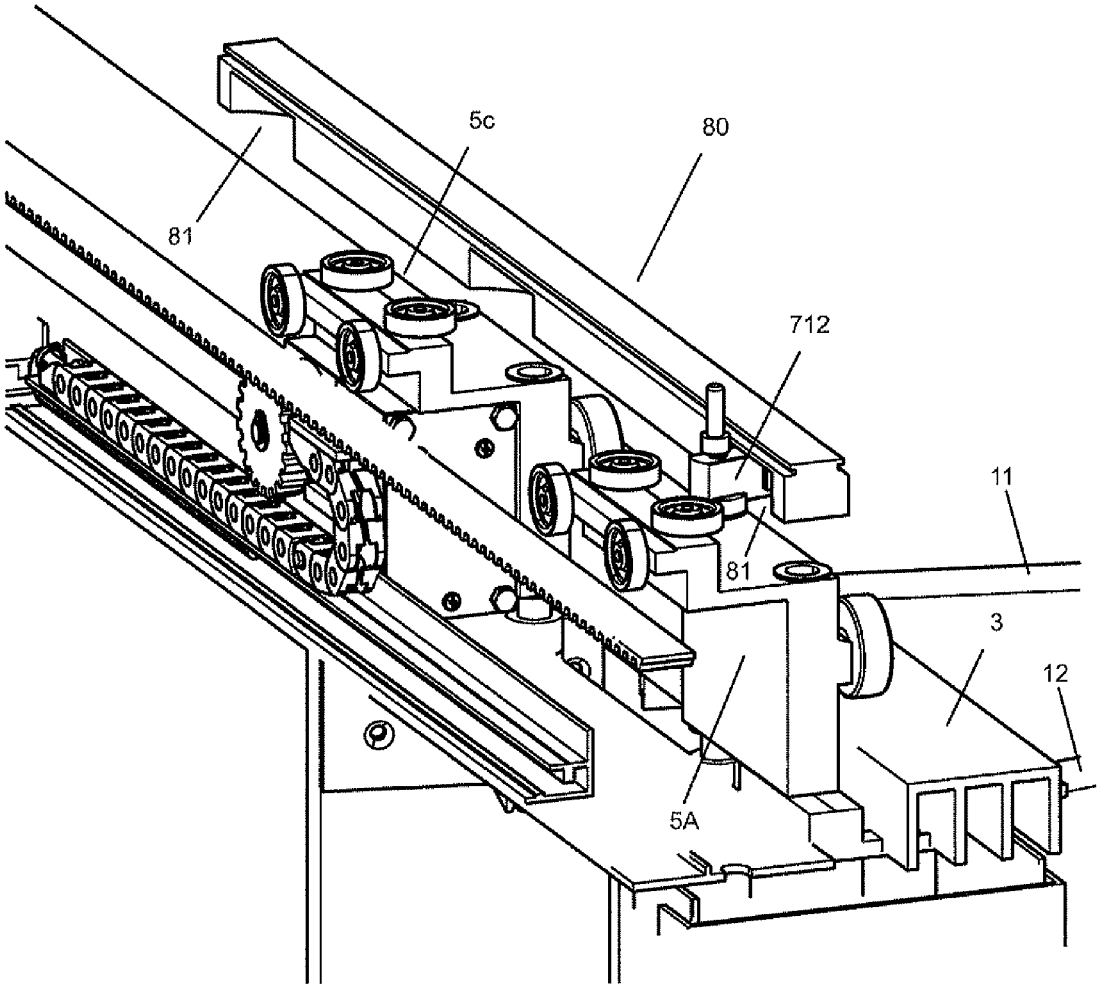
FIG. 17 a section of an inventive foldable sliding wall that nearly comprises a front carriage 5*c* and an end carriage 5A as well as a mounted coupling member body 80 without rail 2.

FIG. 17 shows a part of an inventive foldable sliding wall, which merely comprises a front carriage 5*c* and an end carriage 5A as well as a mounted coupling member body 80 without head rail 2. The end carriage 5A is provided with an asymmetrical rotor 712, which has entered and turned in the first rotor chamber 81. Due to the asymmetrical embodiment, the rotor 712 will not require space on the other side of the road to channel 85.

LITERATURE

[1] U.S. Pat. No. 6,397,522B1
[2] U.S. Pat. No. 7,260,916B2
[3] U.S. Pat. No. 6,301,833B1
[4] U.S. Pat. No. 6,286,258B1
[5] Product catalogue of HAWA AG "Baubeschläge für Faltschiebeläden"
[6] US2010154174A1
[7] U.S. Pat. No. 7,637,177B2

LIST OF REFERENCE NUMERALS

1 foldable sliding wall
10 top of the wall elements 11-16
11-16 wall elements
11 first or end wall element
16 last or front wall element
18 protection profile
18A, 18C terminating profile
180, 180*f* profile holder
19 hinge profile
2 head rail
201 first side member of the rail 2
202 second side member of the rail 2
203 central member of the rail 2
21 first carrier channel
210 supporting and holding element
22 second carrier channel
220 support element
23 guide channel
24 retaining grooves
25 mounting channel for the toothed belt 63
26 traction channel
3 stabilising rail
31 passage
32 stabilising channel
33 guide element
4 foot rail
41 guide channel in the foot rail 4
5A, 5B, 5C head carriages
5Af, 5Bf, 5Cf foot carriages
50A, 50B, 50C carriage bodies
501 vertical first profile part
502 horizontal second profile part
503 vertical third profile part
51 first carriage wheels
52 second carriage wheels
53 guide wheels
55 bores
61 drive motor in the front carriage 5C
62 drive wheel
63 toothed belt, cog rail
64 cable chain
65 supply lines for power and, if necessary, data
71 head fitting
71*f* foot fitting
711*f* connecting shaft
711R rotor shaft
711H holding shaft
7111 holding flange
712 rotor

7121 rotor head
713, 713*f* fitting lever
714 fitting leave
72 guide fitting
721 guide cam
73 support bracket
731 support cam
74 guide element
8 coupling member
80 coupling member body (removable or integrated)
81 rotor chamber
85 rotor channel
86 mounting channel

The invention claimed is:

1. Foldable sliding wall for closing an opening of a building comprising at least a first and a second wall element that are pivotally connected to one another and that are pivotally held by a first and a second head carriage, which are displaceably supported in a head rail, with a first head fitting that is mounted at the upper side of the first wall element and that is connected to a first shaft, which is supported in a first carriage body of the first head carriage and with a second head fitting that is mounted at the upper side of the second wall element and that is connected to a second shaft, which is supported in a second carriage body of the second head carriage, wherein said first head fitting comprises a first lever that is connected to the first shaft, which is a rotor shaft and said second head fitting comprises a second lever that is connected to the second shaft, which is a holding shaft, said head rail comprises a rotor channel with at least one coupling member having at least one rotor chamber, and said rotor shaft is holding a rotor, which, if aligned in parallel to the head rail, is transferable within the rotor channel, and which, if not aligned in parallel to the head rail, is arrested in the rotor chamber.

2. Foldable sliding wall according to claim 1, wherein the coupling member is part of the head rail and extends at least along the parking region of the head rail or wherein at least one coupling member body, which comprises the coupling member, is held by profile elements within the head rail.

3. Foldable sliding wall according to claim 1, wherein more than two wall elements are provided, that are alternatingly held with one of the rotor shafts and one of the holding shafts and with the carriage body of at least one of the head carriages holding a rotor shaft and a holding shaft that are connected to neighbouring wall elements.

4. Foldable sliding wall according to claim 1, wherein foot fittings are connected at the lower side of each of the wall elements, each foot fitting provided with a fitting lever that holds a connecting shaft coaxially aligned with the rotor shaft or the holding shaft of the corresponding first or second head fitting and wherein a foot rail is provided in which foot carriages, each foot carriage holding one or two of the connecting shafts.

5. Foldable sliding wall according to claim 1, wherein one of the head carriages is holding a protection profile between the rotor shaft and the holding shaft and thus between two of the wall elements, which protection profile exhibits on sides facing the wall elements a concave surface.

6. Foldable sliding wall according to claim 5, wherein each protection profile is connected to one of the head carriages and to one of the foot carriages.

7. Foldable sliding wall according to claim 1, wherein at least the wall elements that are held each with one of the rotor shafts) are provided on the top with a guide cam and wherein a stabilising rail having a stabilising channel is connected or integrated into the head rail and is provided with at least one passage, through which the guide cam of one of the wall elements, which is held pivotally by the related rotor shaft with the rotor arrested in the rotor chamber, can pass through into or out of the stabilising channel.

8. Foldable sliding wall according to claim 7, wherein the first wall element is displaceable so that the related guide cam that has passed through the passage is transferable within the stabilising channel to a position where it is securely held within the stabilising channel or wherein the first wall element is displaceable together with at least one of the other wall elements into a parking region or storage area that is not within the cross section of the opening of the building.

9. Foldable sliding wall according to claim 7, wherein a support cam is provided on top of at least one of the wall elements, which support cam is abutting the outside of the stabilising rail, if the related wall element is aligned in parallel to the head rail or perpendicularly to the head rail in the parking region.

10. Foldable sliding wall according to claim 1, wherein for each head carriage that is supporting a rotor shaft a stop is provided within the head rail that is constituted by a stop element attached to the head rail or that is constituted by the carriage bodies of the neighbouring head carriages, which stop is holding the related head carriage in the parking region in a position, in which the related rotor is rotatable in the related rotor chamber.

11. Foldable sliding wall according to claim 1, wherein the head carriages are provided with guide wheels, which are held with wheel shafts that are mounted on top of the carriage bodies aligned in parallel with the rotor shafts and the holding shafts and wherein the head rail is provided with a guide channel, in which the guide wheels are displaceably held.

12. Foldable sliding wall according to claim 1, wherein the head carriage of the front wall element is provided with a motor.

13. Foldable sliding wall according to claim 11, wherein the motor is provided with a drive shaft holding a cog wheel, which is engaged in a linear toothing, a toothed belt or a cog rail, arranged in the head rail.

14. Foldable sliding wall according to claim 11, wherein with a cable chain holding electrical lines that are connected to the motor and wherein the cable chain, which is arranged within the head rail, consists of chain elements that are pivotally connected with one another.

15. Head carriage with a rotor for a foldable sliding wall according to claim 1 with a carriage body that is traversed by a two bores in which the rotor shaft and the holding shaft are held aligned in parallel and wherein the rotor shaft is holding the rotor.

* * * * *